US011391237B2

(12) United States Patent
Weiss et al.

(10) Patent No.: US 11,391,237 B2
(45) Date of Patent: Jul. 19, 2022

(54) PISTON FOR INTERNAL COMBUSTION ENGINES, AND USE OF A PISTON FOR INTERNAL COMBUSTION ENGINES

(71) Applicant: FEDERAL-MOGUL NURNBERG GMBH, Nuremberg (DE)

(72) Inventors: Rainer Weiss, Nuremberg (DE); Laszlo Pelsoeczy, Kurten (DE)

(73) Assignee: Federal-Mogul Nurnberg GmbH, Nuremberg (DE)

( * ) Notice: Subject to any disclaimer, the term of this patent is extended or adjusted under 35 U.S.C. 154(b) by 0 days.

(21) Appl. No.: 15/733,953

(22) PCT Filed: May 10, 2019

(86) PCT No.: PCT/EP2019/062035
§ 371 (c)(1),
(2) Date: Dec. 1, 2020

(87) PCT Pub. No.: WO2019/238321
PCT Pub. Date: Dec. 19, 2019

(65) Prior Publication Data

US 2021/0231080 A1 Jul. 29, 2021

(30) Foreign Application Priority Data

Jun. 11, 2018 (DE) ..... 10 2018 209 267.2

(51) Int. Cl.
*F02F 3/00* (2006.01)

(52) U.S. Cl.
CPC .... *F02F 3/0084* (2013.01); *F02F 2003/0007* (2013.01)

(58) Field of Classification Search
CPC ..... C21D 2211/005; C21D 2211/006; C21D 2211/009; C22C 37/04; F16J 9/26
USPC ..... 123/193.6
See application file for complete search history.

(56) References Cited

U.S. PATENT DOCUMENTS

| | | | | |
|---|---|---|---|---|
| 3,943,908 | A | 3/1976 | Kubis et al. | |
| 4,581,983 | A | 4/1986 | Moebus | |
| 6,209,881 | B1 | 4/2001 | Michel et al. | |
| 7,780,908 | B2 * | 8/2010 | Hsieh | C22C 38/02 420/76 |
| 2003/0051776 | A1 | 3/2003 | Enya et al. | |
| 2004/0182200 | A1 * | 9/2004 | Takiguchi | C22C 33/0278 75/246 |
| 2011/0274946 | A1 * | 11/2011 | Severing | C21D 9/38 164/113 |
| 2014/0318516 | A1 * | 10/2014 | Edmo | C22C 37/04 420/10 |
| 2017/0218488 | A1 * | 8/2017 | Anjiki | C21D 5/00 |

FOREIGN PATENT DOCUMENTS

| | | | |
|---|---|---|---|
| CN | 104024449 | A | 9/2014 |
| CN | 106715739 | A | 5/2017 |
| DE | 2253868 | A | 10/1974 |
| DE | 2919638 | A1 | 11/1980 |
| DE | 8501763 | U1 | 12/1987 |
| DE | 19629970 | C1 | 3/1998 |
| DE | 202010006651 | U1 | 8/2010 |
| DE | 102016225637 | A1 | 6/2018 |
| EP | 0821073 | A1 | 1/1998 |
| EP | 0878647 | A2 | 11/1998 |
| EP | 3202935 | A1 | 8/2017 |
| JP | 2000045011 | A | 2/2000 |

OTHER PUBLICATIONS

International Search Report, dated Jul. 15, 2019 (PCT/EP2019/062035).

Martin Selin et al. "Regression Analysis of Thermal Conductivity Based on Measurements of Compacted Graphite Irons" Metallurgical and Materials Transactions A, Springer-Verlag, New York, vol. 40, No. 13, Sep. 25, 2009 (Sep. 25, 2009), pp. 3235-3244 DOI: 10.1007/S11661-009-0042-8 ISSN: 1543-1940, XP019754938; p. 3240, left col. lines 3-7; Figure 9.

Founding—Spheroidal graphite cast irons, DIN EN 1563:2012-03, DIN-adopted European Standard, Mar. 2012.

* cited by examiner

*Primary Examiner* — Long T Tran
*Assistant Examiner* — James J Kim
(74) *Attorney, Agent, or Firm* — Robert L. Stearns; Dickinson Wright, PLLC

(57) ABSTRACT

A diesel engine piston is cast in one piece and consists of almost fully pearlitic cast iron with spheroidal graphite as the piston material. Such a piston is used for "light vehicle" diesel engines, "heavy duty" diesel engines and "large bore" diesel engines.

6 Claims, No Drawings

PISTON FOR INTERNAL COMBUSTION ENGINES, AND USE OF A PISTON FOR INTERNAL COMBUSTION ENGINES

BACKGROUND

1. Technical Field

The present invention relates to a piston for internal combustion engines and to the use of a piston for internal combustion engines.

2. Related Art

Pistons for automobile diesel engines, for example, are conventionally produced by joining by HIW welding a forged steel lower part and a steel upper part machined from bar stock. Once both parts have been pre-machined, during which the cooling channel required for the piston is formed by machining, they are joined by means of a friction welding or HIW process and are subsequently heat-treated and finished. Thus, the production of corresponding steel pistons is conventionally based on a forged basic material and a plurality of components are joined together, usually by way of a thermal joining process. This production method is comparatively complex and expensive, however. In view of this currently conventional technology, it is desirable to provide a piston for an internal combustion engine which is easier and less expensive to produce and which nevertheless has at least the properties of conventional steel pistons.

SUMMARY

An inexpensive and reliable alternative is provided to forged steel pistons and steel pistons composed of a plurality of parts joined together by way of thermal joining processes (welding processes), in particular pistons for internal combustion engines and specifically pistons for automobile diesel engines. A piston is cast in one piece of almost fully pearlitic cast iron with spheroidal graphite. Here, "cast in one piece" means that the piston consists of a single piece and not of a plurality of parts joined together, and that this one-piece piston is produced as a whole, entirely by way of casting.

Accordingly, piston blanks, in particular for automobile diesel engines but not limited thereto, are produced in one piece of spheroidal graphite cast iron by means of a casting process. With this forming technology the number of procedural steps in the production of a corresponding piston can be reduced compared with production from a plurality of pieces of steel stock. Moreover, this one-piece production of the piston by way of a casting process can prevent problems that would otherwise typically arise in the case of production from a plurality of parts and joining them together. Furthermore, the cooling channel in the piston, inter alia, can be made comparatively inexpensively using a lost core. This eliminates the need for costly, separate machining processes.

An important aspect of the present invention is the use of a high-strength and at the same time inexpensive casting material. In the present invention, fully pearlitic cast iron with spheroidal graphite of high strength is used as the piston material, which achieves or even surpasses the properties specified in DIN EN 1563:2012-03 for the material EN-GJS-700-2. The piston material according to the invention is optimized in terms of increased thermal stability. Thus, the tensile strength and fatigue strength (HCF) at operating temperatures of 500° C. and above are considerably improved. The piston according to the invention therefore has at least the positive properties of pistons produced from the materials GJS-700-2 and GJS-800-2. The microstructure of the piston material in the cast state is fully pearlitic and, in contrast to the standardized materials (GJS), the material according to the invention is stabilized as a whole by the elements Cu, Sn, Ni and Sb, which suppress carbon diffusion in the iron and stabilize the pearlite at operating temperatures.

The attribute "almost fully pearlitic" is to be understood such that microstructurally and in the structure of the piston material primarily fully pearlitic cast iron with spheroidal graphite can be found. Other phases can therefore only be found to a limited extent and in small proportions. The material structure of the diesel engine piston according to the invention comprises evenly distributed graphite with primarily spherical morphology and pearlite as the matrix, with small ferrite regions around the graphite phases in part.

In a preferred embodiment of the present invention, the free ferrite content is ≤2.6%, preferably ≤1.0% and more preferably ≤0.5%. As already qualitatively stated above, the material of the piston according to the invention comprises only very small proportions of phases deviating from fully pearlitic cast iron with spheroidal graphite. One of these may be ferrite, wherein the content thereof in the structure is less than approximately 3.0% overall. On average, the ferrite content is preferably ≤1.0%, wherein local accumulations of ferrite may occur in which the content may be up to 2.6%. In particular, such accumulations occur near the casting core or the feeder.

The material of the piston according to the invention advantageously comprises, or optionally consists of, the following components/elements in percent by weight (wt. %): C: 3.23, preferably 3.4 to 3.81, preferably 3.8; Si: 2.2 to 3.23, preferably 3.0; Mn: 0.04, preferably 0.2 to 0.4; Mg: 0.0025 to 0.054, preferably 0.04; P: <0.1; S: 0 to 0.020, preferably 0.007; Cr: <0.1; Ni: <0.1; Mo: <0.05; Nb: <0.1; Cu: 0.4 to 1.0; Pb: <0.002; B: <0.001; W: <0.01; Ti: <0.015; Sn: 0.05 to 0.135, preferably 0.1; V: <0.1; Sb: ≤0.002, and as the remainder iron and unavoidable impurities.

The material of the piston according to the invention further advantageously comprises, or optionally consists of, the following components/elements in percent by weight (wt. %): C: 3.23 to 3.81; Si: 2.2 to 3.23; Mn: 0.04 to 0.4; Mg: 0.0025 to 0.054; P: 0.005 to 0.1; S: 0.003 to 0.020; Cr: 0.01 to 0.1; Ni: 0.006 to 0.1; Mo: 0.002 to 0.05; Nb: <0.1; Cu: 0.4 to 1.0; Pb: <0.007; B: <0.01; W: 0.001 to 0.1; Ti: <0.015; Sn: 0.05 to 0.135; V: 0.002 to 0.3; Sb: 0.001 to 0.07, and as the remainder iron and unavoidable impurities.

The material of the piston according to the invention further advantageously comprises, or optionally consists of, the following components/elements in percent by weight (wt. %): C: 3.23 to 3.81; Si: 2.2 to 3.23; Mn: 0.04 to 0.4; Mg: 0.0025 to 0.054; P: <0.1; S: 0 to 0.020; Cr: <1.0; Ni: <1.0; Mo: <0.5; Nb: <0.3; Cu: 0.3 to 2.0; Pb: <0.009; W: <1.0; Ti: <0.015; Sn: 0.05 to 0.3; V: <1.0; Sb: ≤0.05, and as the remainder iron and unavoidable impurities.

Optionally, the piston material consists of one of the aforementioned alloys, i.e. it does not comprise any other components or chemical elements in effective and functional contents. The composition according to the invention of the material of the piston is characterized in particular by the fact that elements which reduce or prevent the diffusion of carbon in the steel are admixed therein in a targeted manner. In particular, the contents of copper (Cu), tin (Sn) and nickel (Ni) as according to the invention can be considered to be such functional additions. As compared with the aforementioned standardized materials, a particularly good high-temperature stabilisation is thereby achieved by suppressing the carbon diffusion, which is associated with corresponding advantageous properties for the internal combustion engine piston as a whole.

A further aspect of the present invention is the use of a piston, in particular a piston as described above, for internal combustion engines and in particular for "light-vehicle diesel" (LVD) engines, "heavy duty" (HD) diesel engines such as those for heavy goods vehicles and diesel engines with diameters of up to ca. 145 mm, and "large bore" diesel engines such as large-bore piston engines in ships, or for stationary applications. The piston according to the present invention is therefore not limited to pistons for comparatively small automotive diesel engines; rather, it can also be produced and used for larger engines and also for gasoline and gas engines.

DETAILED DESCRIPTION

A specific example of a piston material as according to the present invention is a substantially fully pearlitic cast iron with spheroidal graphite, which consists of the following elements in wt. %: C: 3.7; Si: 2.6; Mn; 0.3; Mg: 0.03; P: 0.02; S: 0.01; Cr: 0.05; Ni: 0.03; Mo: 0.01; Nb: 0.01; Cu: 0.6; Pb: 0.001; B: 0.0001; W: 0.001; Ti: 0.01; Sn: 0.06; V: 0.1, and as the remainder Fe and unavoidable impurities.

As a further example of the present invention an automobile diesel engine piston was cast by way of a gravity sand casting process and the following chemical composition was determined in wt. %: C: 3.38%; Si: 3.05%; Mn: 0.160%; P: 0.065%; S: 0.007%; Cr: 0.025%; V: 0.006%; Mo: 0.005%; Ni: 0.015%; Cu: 0.737%; Mg: 0.054%; Ti: 0.0084%; W: 0.0050%; Sn: 0.0980%; Nb: 0.0048%; Al: 0.0219%; Ca: 0.0013%; Pb: 0.0006%; N: 0.0077%; Co: 0.0065%; As: 0.0057%; Bi: 0.0018%; Ce: 0.0164%; Sb: 0.0007%; Te: 0.0010%; La: 0.0032%; Zn: 0.0004%.

Cross sections of this piston were produced and samples were taken at different points in the piston, which were tested with respect to the mechanical properties thereof and for which structural analyses were also carried out. On the basis of eleven samples taken, an average hardness HB 187.5/2.5 of 300 was determined. Overall, the piston had good homogeneity in terms of this hardness value, i.e. there were no significant fluctuations in hardness across the cross section of the piston. The samples taken at the corresponding points of the piston cross section were prepared metallographically and tested microscopically with respect to the different phases, and a substantially uniform distribution of spheroidal graphite in a pearlite matrix as well as only very small contents of ferrite in the microstructure were determined.

Tables 1 and 2 below list a series of compositions (Samples 1 to 11) of casting alloys which represent the material of the piston according to the invention and which were determined in correspondingly produced pistons.

TABLE 1

| Sample | 1 | 2 | 3 | 4 | 5 |
|---|---|---|---|---|---|
| | Component in wt. % | | | | |
| C | 3.691 | 3.673 | 3.663 | 3.669 | 3.65 |
| Si | 3.09839 | 3.02632 | 2.99495 | 2.96243 | 3.220427 |
| Mn | 0.0408 | 0.0401 | 0.03963 | 0.03998 | 0.062328 |
| P | 0.03832 | 0.03883 | 0.03841 | 0.03876 | 0.076619 |
| S | 0.0129 | 0.0101 | 0.0104 | 0.0115 | 0.0075 |
| Cr | 0.01349 | 0.01305 | 0.0126 | 0.01246 | 0.026776 |
| V | 0.00747 | 0.00722 | 0.00732 | 0.00733 | 0.007335 |
| Mo | 0.00301 | 0.00278 | 0.00277 | 0.00275 | 0.003535 |
| Ni | 0.01242 | 0.01215 | 0.012 | 0.01202 | 0.015239 |
| Cu | 0.72771 | 0.73109 | 0.42569 | 0.42531 | 0.417631 |
| Mg | 0.03901 | 0.0359 | 0.03442 | 0.03121 | 0.038429 |
| Ti | 0.00746 | 0.00724 | 0.00724 | 0.00714 | 0.007456 |
| W | 0.00126 | 0.00093 | 0.00102 | 0.00095 | 0.0002 |
| Sn | 0.0566 | 0.0516 | 0.07648 | 0.07774 | 0.099729 |
| Nb | 0.00089 | 0.00081 | 0.0009 | 0.00087 | 0.000946 |
| Al | 0.01489 | 0.01464 | 0.01393 | 0.01296 | 0.017827 |
| Ca | 0.00093 | 0.00083 | 0.00092 | 0.00075 | 0.000313 |
| Pb | 0.00045 | 0.00049 | 0.00054 | 0.00054 | 0.000906 |
| N | 0.00315 | 0.00349 | 0.00334 | 0.00347 | 0.005176 |
| Co | 0.00656 | 0.0066 | 0.00664 | 0.00667 | 0.007799 |
| As | 0.0034 | 0.00348 | 0.00373 | 0.00393 | 0.005986 |
| Bi | 0.00072 | 0.00079 | 0.00089 | 0.00086 | 0.000739 |
| Ce | 0.01353 | 0.01343 | 0.01357 | 0.01235 | 0.012057 |
| Sb | 0.0004 | 0.0004 | 0.0004 | 0.0004 | 0.000479 |
| Te | 0.0008 | 0.0008 | 0.0008 | 0.0008 | 0.0008 |
| La | 0.00282 | 0.00281 | 0.00274 | 0.00253 | 0.001638 |
| Zn | 0.00015 | 0.00014 | 0.00013 | 0.00014 | 0.000175 |
| Fe | Remainder + impurities | Remainder + impurities | Remainder + impurities | Remainder + impurities | Remainder + impurities |

TABLE 2

| Sample | 6 | 7 | 8 | 9 | 10 | 11 |
|---|---|---|---|---|---|---|
| | Component in wt. % | | | | | |
| C | 3.26 | 3.23 | 3.68 | 3.36 | 3.38 | 3.36 |
| Si | 2.737827 | 2.736052 | 3.230111 | 2.85172 | 3.047143 | 2.960463 |
| Mn | 0.317789 | 0.314292 | 0.057017 | 0.171237 | 0.159732 | 0.159244 |
| P | 0.074836 | 0.074415 | 0.075642 | 0.069684 | 0.064893 | 0.064661 |
| S | 0.014 | 0.014 | 0.009 | 0.01 | 0.0068 | 0.0096 |
| Cr | 0.059092 | 0.060118 | 0.020318 | 0.023744 | 0.025457 | 0.025186 |
| V | 0.007076 | 0.007158 | 0.00828 | 0.007839 | 0.006491 | 0.006295 |
| Mo | 0.006718 | 0.006809 | 0.002762 | 0.006728 | 0.005099 | 0.004876 |
| Ni | 0.025739 | 0.025695 | 0.013558 | 0.018661 | 0.015426 | 0.015051 |
| Cu | 0.75797 | 0.75999 | 0.432448 | 0.787839 | 0.736804 | 0.746286 |
| Mg | 0.042563 | 0.045771 | 0.043171 | 0.033834 | 0.053795 | 0.047091 |
| Ti | 0.007716 | 0.007585 | 0.007532 | 0.007826 | 0.008394 | 0.008458 |
| W | 0.002548 | 0.002477 | 0.001271 | 0.005461 | 0.005027 | 0.004383 |
| Sn | 0.133554 | 0.134397 | 0.087247 | 0.120429 | 0.097966 | 0.099455 |
| Nb | 0.012062 | 0.01717 | 0.000675 | 0.00608 | 0.0047966 | 0.004713 |
| Al | 0.014324 | 0.014725 | 0.016096 | 0.019275 | 0.021852 | 0.020247 |
| Ca | 0.00402 | 0.000371 | 0.000799 | 0.000625 | 0.001292 | 0.00112 |
| Pb | 0.000231 | 0.000255 | 0.00057 | 0.000663 | 0.000595 | 0.000603 |
| N | 0.003582 | 0.002003 | 0.00413 | 0.007155 | 0.007662 | 0.007529 |
| Co | 0.007931 | 0.008036 | 0.007317 | 0.007493 | 0.006549 | 0.006485 |
| As | 0.004618 | 0.004283 | 0.005674 | 0.006559 | 0.005716 | 0.005799 |
| Bi | 0.00099 | 0.000904 | 0.001046 | 0.001431 | 0.001707 | 0.001746 |
| Ce | 0.010462 | 0.01077 | 0.012976 | 0.012453 | 0.016401 | 0.015374 |
| Sb | 0.001776 | 0.001577 | 0.000923 | 0.001032 | 0.000683 | 0.001233 |
| Te | 0.000996 | 0.0008 | 0.001329 | 0.001067 | 0.001032 | 0.00123 |
| La | 0.001724 | 0.001722 | 0.002855 | 0.002314 | 0.003197 | 0.003048 |
| Zn | 0.000147 | 0.000121 | 0.000404 | 0.000296 | 0.000386 | 0.000372 |
| Fe | Remainder + impurities | Remainder + impurities | Remainder + impurities | Remainder + impurities | Remainder + impurities | Remainder + impurities |

The invention claimed is:

1. A piston for internal combustion engines, comprising: a one piece casting consisting of almost fully pearlitic cast iron with spheroidal graphite as the piston material;

the piston material comprising the following elements in wt. %:

C: 3.23 to 3.81;

Si: 2.2 to 3.23;

Mn: 0.04 to 0.4;

Mg: 0.0025 to 0.054;

P: 0.005 to 0.1;

S: 0.003 to 0.020;

Cr: 0.01 to 0.1;

Ni: 0.006 to 0.1;

Mo: 0.002 to 0.05;

Nb: <0.1;

Cu: 0.3 to 2.0;

Pb: <0.007;

B: <0.01;

W: 0.001 to 0.1;

Ti: <0.015;

Sn: 0.05 to 0.135;

V: 0.002 to 0.3;

Sb: 0.001 to 0.07;

and as the remainder Fe and unavoidable impurities;

the piston material including a matrix of pearlite;

the piston material including graphite phases with a primarily spherical morphology;

the piston material including a ferrite content of ≤2.6%; and if the ferrite is present, the piston material including regions of the ferrite around the graphite phases.

2. The piston according to claim 1, wherein the ferrite content is <1.0%.

3. The piston according to claim 1, wherein the ferrite content is <0.5%.

4. The piston according to claim 1, wherein the piston material consists of the elements in wt %.

5. The piston according to claim 1, wherein the one piece casting includes a cooling channel.

6. An internal combustion engine comprising the piston according to claim 1.

* * * * *